United States Patent [19]

Walter

[11] Patent Number: 4,658,736

[45] Date of Patent: Apr. 21, 1987

[54] INCINERATION OF COMBUSTIBLE WASTE MATERIALS

[76] Inventor: Herman K. Walter, 60 Norseman Street, Toronto, Ontario, Canada, M8Z 2P8

[21] Appl. No.: 844,954

[22] Filed: Mar. 27, 1986

[51] Int. Cl.[4] ..... F23G 5/00

[52] U.S. Cl. ..... 110/346; 110/210; 110/214; 110/246; 431/5

[58] Field of Search ..... 110/346, 246, 254, 210, 110/214; 431/5; 422/173

[56] References Cited

U.S. PATENT DOCUMENTS

| | | | |
|---|---|---|---|
| 3,901,766 | 8/1975 | Smith | 201/32 |
| 4,037,543 | 7/1977 | Angelo | 110/14 |
| 4,232,614 | 11/1980 | Fitch et al. | 110/246 X |
| 4,245,571 | 1/1981 | Przewalski | 110/246 |
| 4,273,619 | 6/1981 | Angelo | 202/211 |
| 4,361,100 | 11/1982 | Hinger | 110/246 X |
| 4,395,958 | 8/1983 | Caffym et al. | 110/246 |

*Primary Examiner*—Edward G. Favors
*Attorney, Agent, or Firm*—Ridout & Maybee

[57] ABSTRACT

Garbage and other incinerable waste is treated with hot air and steam in a rotary furnace, under conditions inhibiting free and complete combustion, so as to produce a gaseous phase and a solid phase consisting of non-combustible solids. The gaseous phase is mixed with excess air and recirculated combustion gases and passed to a cyclone chamber in which further combustion takes place at a temperature controlled so as to destroy toxic organic compounds and to melt solids such as glass but insufficient to promote excessive nitrogen oxide formation. The gases are then passed through a ceramic heat exchanger, tempered with ambient air to cause any residual molten glass still entrained in the gases to solidify, and passed through a second heat exchanger, clean compressed air being passed through the second and then the first heat exchanger so as to raise its temperature sufficiently to drive a gas turbine.

8 Claims, 4 Drawing Figures

INCINERATION OF COMBUSTIBLE WASTE MATERIALS

This invention relates to the generation of thermal energy utilizing low grade fuels such as incinerable garbage and other combustible solids.

Although the incineration of garbage and other waste materials for disposal purposes, with the concomitant production of useful thermal energy, has a long history, it has proven difficult to achieve efficient and complete combustion of such material whilst avoiding harmful emissions and providing thermal energy in a readily utilized form. Since in most cases incineration will not be carried out in locations where hot gases or steam can be utilized directly, it will usually be desired to convert the thermal energy into electrical energy, utilizing steam and/or clean, hot gases. In particular, if a gas turbine driven generator is utilized, it is desirable that the gases applied thereto be clean and free of harmful erosive products. It is also necessary that the combustion gases generated during incineration be raised to a sufficient temperature to destroy toxic organic chemicals such as polychlorinated biphenyls or dioxins which may be either present in the waste or generated by the combustion process, without being raised to such a high temperature as will result in excessive production of nitrogen oxides. In other words, the combustion conditions must be very carefully controlled despite the necessarily varying properties of the incoming waste material. A further problem which has arisen in the incineration of garbage is that it commonly contains a significant quantity of glass in the form of discarded containers and bottles, and the shattering of this glass during pretreatment of the garbage releases substantial quantities of glass particles which can become entrained in the combustion gases. The combustion process generates temperatures sufficient to melt these particles, and the molten particles can given rise to a serious fouling problem when they become deposited and solidify on parts of the apparatus such as heat exchangers.

An object of the present invention is to provide an incineration system for garbage and other combustible waste materials which can be operated so as to minimize the presence of harmful materials in its waste gases, which can produce clean hot gas at a temperature sufficient for efficient operation of a gas turbine, and which reduces problems due to molten glass fouling.

According to the invention there is provided a method of incinerating combustible waste materials comprising subjecting the materials to a temperature from about 550° C. to about 925° C. sufficient to gasify most of the combustible content thereof, in the presence of a mixture of hot air and steam containing insufficient oxygen to support free combustion, blending the resulting gases with further hot gases and passing the resulting mixture into a vortex rising through a combustion chamber, the further gases containing oxygen sufficient to provide an excess of oxygen over that required to complete combustion and sufficient diluent gases to restrict combustion temperatures in the vortex to about 1250° C. to about 1550° C., passing the gases through a first heat exchanger to transfer part of their thermal energy to a separate flow of compressed air, forming the gases into a further vortex with the admixture of ambient air to reduce their temperature to about 550° C. to about 925° C., passing the gases through a second heat exchanger to preheat the clean compressed air supplied to the first heat exchanger, and passing the gases to a boiler, to produce steam. Preferably the heated air from the first exchanger is used to drive a gas turbine, and the exhaust from the turbine provides the hot air for combustion.

The invention also extends to apparatus for incinerating combustible waste materials comprising an airtight rotary furnace for receiving the waste materials, means for injecting hot oxygen containing gas and steam into the furnace, a gas conduit for receiving gases from the furnace and further oxygen containing gases, a first vortical combustion chamber tangentially receiving gases from said conduit, a ceramic first heat exchanger receiving gases from said first vortical combustion chamber and delivering them tangentially to a second vortical combustion chamber, a second heat exchanger receiving gases from said second vortical combustion chamber, and means to pass compressed gas to be heated successively through said second and first heat exchangers.

Further features of the invention will become apparent from the following description of a presently preferred embodiment thereof with reference to the accompanying drawings, in which.

Figure 1:
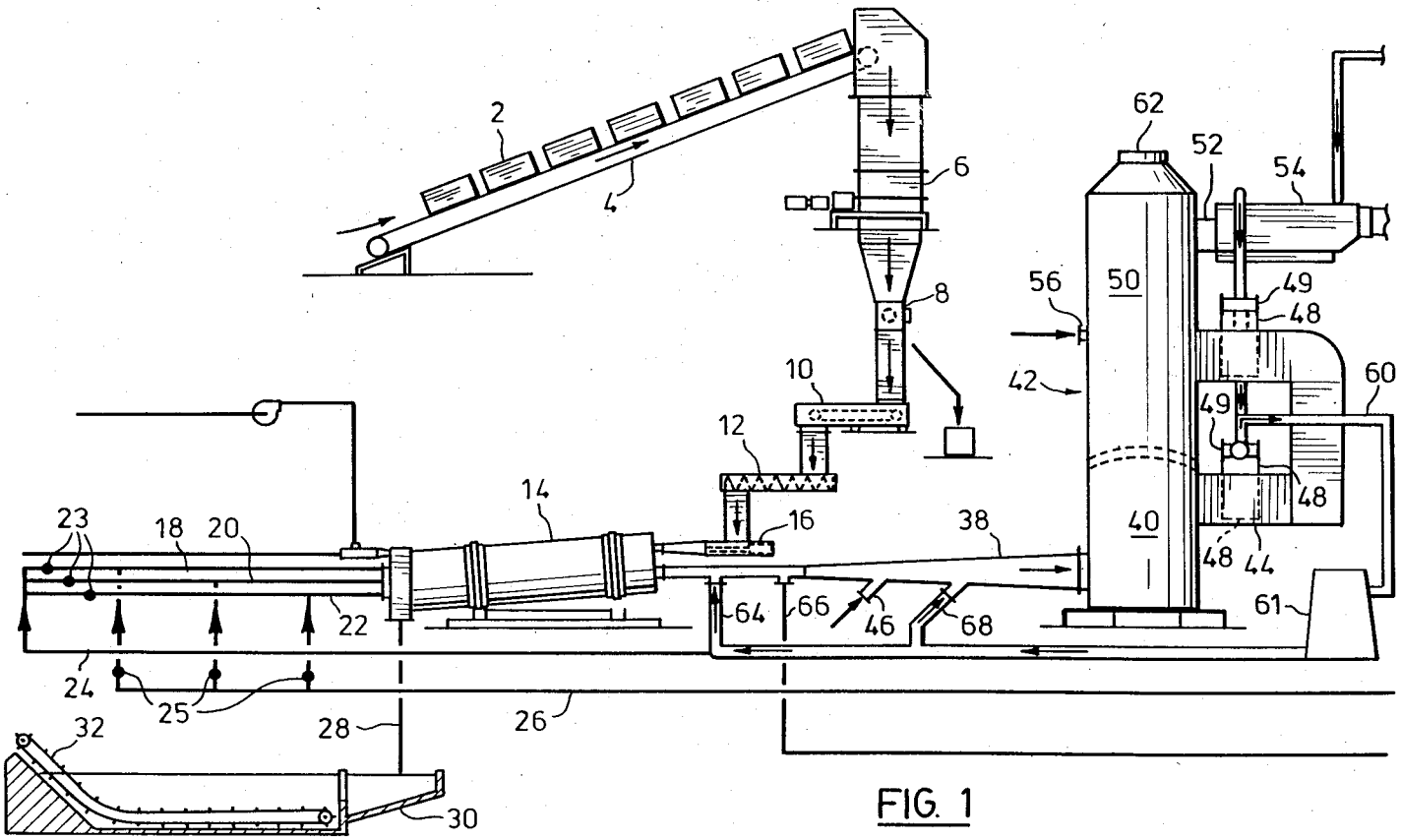
FIG. 1 is a diagrammatic elevation of a plant for implementing the invention.
Figure 2:
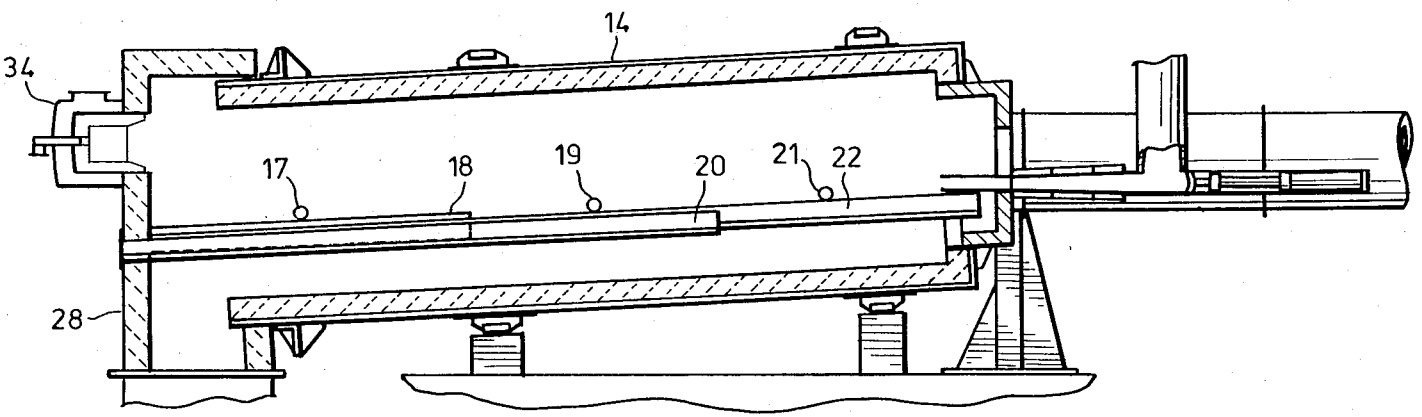
FIG. 2 is a longitudinal cross section of a rotary furnace used in the plant of FIG. 1.
Figure 3:
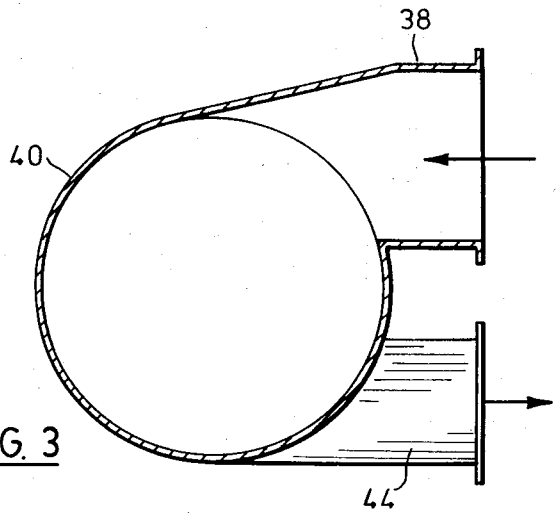
FIG. 3 is a horizontal cross section through a secondary combustion chamber used in the plant of FIG. 1.
Figure 4:
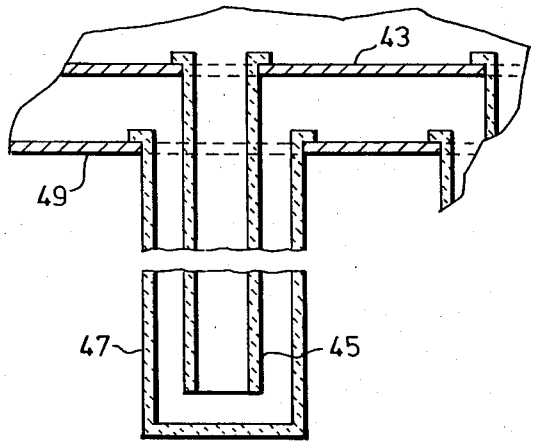
FIG. 4 is a fragmentary sectional view of a heat exchanger used in the plant of FIG. 1.

Referring to FIG. 1, garbage to be incinerated is stored in bales 2 which are fed by a conveyor 4 to a shredder 6 which shreds the material after which ferrous scrap such as baling wire is removed by a magnetic separator 8 and the remaining material is weighed on a belt scale 10 and conveyed by a vibratory or screw feeder 12 before being compressed and discharged into the upper end of an inclined rotary furnace 14 by means of a reciprocable ram feeder 16. The furnace 14 forms a primary combustor for the combustible content of the garbage. As well as the garbage from feeder 16, the furnace receives a mixture of hot air (or other oxygen containing gas) through pipes 18, 20 and 22 which terminate at different points lengthwise of the furnace, and receive hot air from line 24 and steam from line 26. Typically, the air is at about 500° C. and the steam at about 400° C. The oxygen content of the air is deliberately insufficient to secure complete combustion of the combustible content of the garbage, but sufficient to maintain combustion reactions at a sufficient level to maintain a temperature of about 500° C. to about 925° C., typically about 900° C., in the furnace and to decompose and volatilize most of said combustible and volatile material without causing sintering due to melting of the glass content, thus leaving unreactive residues such as ash, glass shards and non-ferrous metals to be discharged at the lower end of the furnace through a water sealed chute 28 into a feed box of a clarifier 30 in which the residues are washed and then discharged by a conveyor 32. An auxiliary burner 34 receiving natural gas and air from a blower 36 is used to bring the furnace 14 up to working temperature during start up.

In order to provide adequate control over the combustion conditions in the rotary furnace 14, despite probable lack of homogeneity in the material fed to the furnace, the supply of air and steam to each of the pipes 18, 20 and 22 (which may be more than three in number) is independently controlled by valves 23 and 25 responsive to temperature readings from thermocouples 17, 19 and 21 located in different parts of the furnace so that local hot or cold spots can be corrected. Entry into the furnace of a substantial mass of either more highly combustible or relatively incombustible material could otherwise cause temperatures to rise or fall locally to unacceptable levels.

Gases generated in the furnace 14 are discharged through a duct 38 which enters tangentially the bottom end of a lower chamber 40 defined in a vertical cylindrical reactor 42. The gas composition is adjusted in the duct 38 by successive additions of further gases, namely further air, typically at about 500° C., added in stages along the duct 38, together with recirculated exhaust gases, typically at about 250° C. The exhaust recirculation is used to moderate combustion temperatures in the chamber to a desired level low enough to inhibit the production of nitrogen oxides, yet high enough to melt residual glass particles which may remain entrained by the gases even after the cyclone separation effect produced by a gas vortex set up in the chamber 40. This vortex extends from the tangential bottom inlet through the duct 38 up to a top outlet through the duct 44. The temperature developed in the vortex is high enough and the retention time is sufficient to destroy any residues of potentially harmful organic compounds such as polychlorinated biphenyls and preventing any possible formation of dioxins. Gas temperatures in the chamber 40 should normally be in the range 1250° C.-1550° C. An additional gas burner 46 is provided in the duct 38 to help attain desired working temperatures during start up. The amount of air added is such as to provide an excess of oxygen in the combustion gases.

Hot gases from the duct 44 are applied to heat exchangers 48, which are preferably of the ceramic tube type in order to withstand the temperatures involved. The gases to be heated are passed through arrays of vertically extending ceramic tube assemblies located in two vertically spaced horizontal legs of the duct 44. This arrangement provides for approximately equal thermal expansion of both legs, thus simplifying structural design. Typically, see FIG. 5 each tube 47 comprises an outer tube suspended from and communicating with a header 49 at its top end, the tube being closed at its bottom end, and an inner smaller diameter tube 45 suspended from a separate header 43 and opening at its bottom end within a bottom portion of the outer tube so as to provide a path between the two headers. The hot gases in the duct pass over the outer surfaces of the outer tubes. Any residual suspended solid or liquid matter in the hot gases should strike the tubes and drain or fall to the bottom of the duct.

The still hot gases from the duct 44, typically at 1000° C. to 1250° C., re-enter the reactor 42 at the lower end of an upper chamber 50, again tangentially, and after vertical movement upward through the chamber 50, exit tangentially through duct 52 to a further heat exchanger 54. Ambient air is introduced into the upper chamber 50 through a port 56, both so as to produce a substantial excess of oxgen content in the gases and thus assist in completing combustion, and so as to reduce the gas temperature at the duct 52 to about 550° C. to about 925° C., preferably about 700° C. to 900° C. The heat exchanger 54 may thus be of conventional construction, and is used to prevent compressed gas, typically mainly air, in a first stage before further heating in the heat exchanger 48. Typically the air enters the heat exchanger 54 through duct 56 at about 350° C., leaves duct 58 at about 700° C., and is further heated in the heat exchangers 48 to about 950° C., before leaving through a duct 60. The heat exchangers may for example be used to heat air or a gas mixture used to drive a turbine 61, the exhaust from this turbine providing the hot air or oxygen containing gas required for introduction into rotary furnace 14 and the duct 38. Similarly, the steam required by the furnace 14 may be provided by a waste heat boiler which receives the exhaust gases from the heat exchanger 54 typically at about 450° C. to 500° C., the steam being superheated by the turbine exhaust gases in a suitable heat exchanger.

The reduction of the temperature of the gases occurring in the chamber 50 is such as to solidify any residual glass particles still remaining in suspension, and such as to permit conventional construction of the heat exchanger 54. The tangential entry and exit of the gases and their vortical movement through the chamber assists in disentraining such particles, whilst their solidification should prevent fouling of the heat exchanger 54. The tower 42 is provided with a dump cap 62 at the top of chamber 50, which forms part of an emergency relief system in the event of a failure in a turbine system driven by hot gases produced by the apparatus. Such a failure may require a very rapid cut off of hot gas input to the turbine system, and dumping of the exhaust gases from the chamber 50 may then be necessary to protect the heat exchanger 54 and other downstream equipment from excessive temperatures. Since combustion should have been substantially completed and most solid material removed, such emergency dumping does not constitute a major pollution hazard.

Operation of the system will be largely apparent from the description above. An exemplary system might receive 1920 lbs. of garbage per hour, having a recoverable heat yield of about 5584 BTU/lb., which would be heated in the furnace 14 with 3794 lbs/hr of turbine exhaust gases, essentially hot air containing in this example about 15% by weight of steam and possible minor additions of combustion gases, together with sufficient steam to maintain a desired reaction temperature in the furnace 14. In the duct 38, successive additions of turbine exhaust gases, together with cooled recycled combustion gases, themselves having a substantial oxygen content, for example 13.6% by weight, provide an excess of oxygen over that required to provide complete combustion of the gases, the quantity of recycled combustion gases again being adjusted to maintain a desired combustion temperature in chamber 40, which is sufficient to liquefy most entrained solid residues in the gases whilst low enough to inhibit generation of nitrogen oxides. Typically about 4270 lbs. of turbine exhaust gases will be added through a first duct 64, about 1695 lbs/hr of recycled combustion gases through a second duct 66, about 9252 lbs/hr of the turbine exhaust gases through duct 68. About 2618 lbs/hr of further ambient air are introduced into chamber 50 to adjust the temperature of the gases entering the heat exchanger 54 and bring their oxygen content to the 13.6% figure mentioned above.

By dividing both the combustion process and heat recovery into stages as described it is possible to achieve very complete combustion and destruction of harmful organic compounds whilst providing clean heated gas at an advantageously high temperature, inhibiting fouling of the apparatus by solid residues, particularly glass, and inhibiting generation of harmful constituents such as nitrogen oxides.

I claim:

1. A method of incinerating combustible waste materials comprises subjecting the materials to a temperature from about 500° C. to about 925° C. sufficient to gasify most of the combustible content thereof, in the presence of a mixture of hot air and steam containing insufficient oxygen to support free combustion, blending the resulting gases with further hot gases and passing the resulting mixture into a vortex rising through a combustion chamber, the further gases containing oxygen sufficient to provide an excess of oxygen over that required to complete combustion and sufficient diluent gases to restrict combustion temperatures in the vortex to temperatures in the range from about 1250° C. to about 1550° C., passing the gases through a first heat exchanger to transfer part of their thermal energy to a separare flow of compressed air, forming the gases into a further vortex with the admixture of ambient air to reduce their temperature to a temperature in the range from about 550° C. to about 925° C., passing the gases through a second heat exchanger to preheat the clean compressed air supplied to the first heat exchanger, and passing the gases to a boiler, to produce steam.

2. A method according to claim 1, wherein the heated air from the first heat exchanger is used to drive a gas turbine, and the exhaust from the turbine provides the hot air for combustion.

3. Apparatus for incinerating combustible waste materials comprises an airtight rotary furnace for receiving the waste materials, means for injecting hot oxygen containing gas and steam into the furnace, a gas conduit for receiving gases from the furnace and further oxygen containing gases, a first vortical combustion chamber tangentially receiving gases from said conduit, a ceramic first heat exchanger receiving gases from said first vortical combustion chamber and delivering them tangentially to a second vortical combustion chamber, a second heat exchanger receiving gases from said second vortical combustion chamber, and means to pass compressed gas to be heated successively through said first and second heat exchangers.

4. Apparatus according to claim 3, wherein means for injecting the hot oxygen containing gas and steam comprises pipes extending within and parallel to the axis of the rotary furnace and discharging at multiple points therealong.

5. Apparatus according to claim 4, including means to sense the temperature in different parts of the furnace, and means to control independently the supply of hot gas and steam to said multiple discharge points.

6. Apparatus according to claim 3, wherein the first and second vortical combustion chambers are arranged one beneath the other in a vertical reactor.

7. Apparatus according to claim 3, wherein the ceramic heat exchanger comprises multiple tubular suspended elements, each having an outer tube closed at the bottom and communicating at the top with a first header, and an inner tube communicating at the bottom with the outer tube and at the top with a second header.

8. Apparatus according to claim 3, wherein the ceramic heat exchanger comprises two separate but similar portions, one located in a horizontal conduit outgoing from said first vortical combustion chamber, and the other located in a horizontal conduit entering the second combustion chamber, the distal ends of the conduits being connected.

* * * * *